United States Patent [19]

O'Dell

[11] 4,167,293

[45] Sep. 11, 1979

[54] SPROCKET TIGHTENER

[75] Inventor: Larry A. O'Dell, Columbus, Ohio

[73] Assignee: Dresser Industries, Inc., Dallas, Tex.

[21] Appl. No.: 913,170

[22] Filed: Jun. 6, 1978

[51] Int. Cl.[2] ..... E21C 25/10

[52] U.S. Cl. ..... 299/82; 175/89; 299/84; 172/122; 74/243 R; 83/830

[58] Field of Search ..... 299/63, 78, 82, 83, 299/84; 175/89, 90; 172/122, 125; 74/243 R, 243 C, 243 CS, 253 R, 249; 30/381-387; 83/830

[56] References Cited

U.S. PATENT DOCUMENTS

| | | | |
|---|---|---|---|
| 590,649 | 9/1897 | Ribyn, Jr. | 74/243 R |
| 2,398,675 | 4/1946 | Sloane | 299/84 |
| 2,865,621 | 12/1958 | Proctor | 299/82 |
| 3,436,801 | 4/1969 | Berg | 74/243 X |
| 3,787,091 | 1/1974 | Paolini et al. | 299/84 |
| 3,982,688 | 9/1976 | Taylor | 299/82 X |

*Primary Examiner*—Ernest R. Purser
*Assistant Examiner*—Nick A. Nichols, Jr.
*Attorney, Agent, or Firm*—Burns, Doane, Swecker & Mathis

[57] ABSTRACT

The invention concerns a machine for cutting earth formations, of the type comprising a vehicle body, and a power driven rotary cutter mounted on the body. The cutter includes a wheel assembly and a cutter chain mounted in circular fashion around the wheel assembly. The cutter chain comprises a plurality of links connected together by transverse pins, and cutter-receiving sockets carried by the links. The wheel assembly comprises a peripheral surface for supporting the pins, and a plurality of circumferentially spaced recesses in the surface, the quantity and spacing of the recesses corresponding to the quantity and spacing of the transverse pins in the chain such that the pins can be positioned in the recesses. The recesses are of sufficient depth to support the chain in a slackened condition when the pins are positioned in the recesses. The diameter formed by non-recessed portions of the surface is large enough to prevent the pins from traveling completely out of the recesses during earth cutting operations in which the pins travel outwardly up the sides of the recesses to tighten the chain.

8 Claims, 7 Drawing Figures

Fig. 1
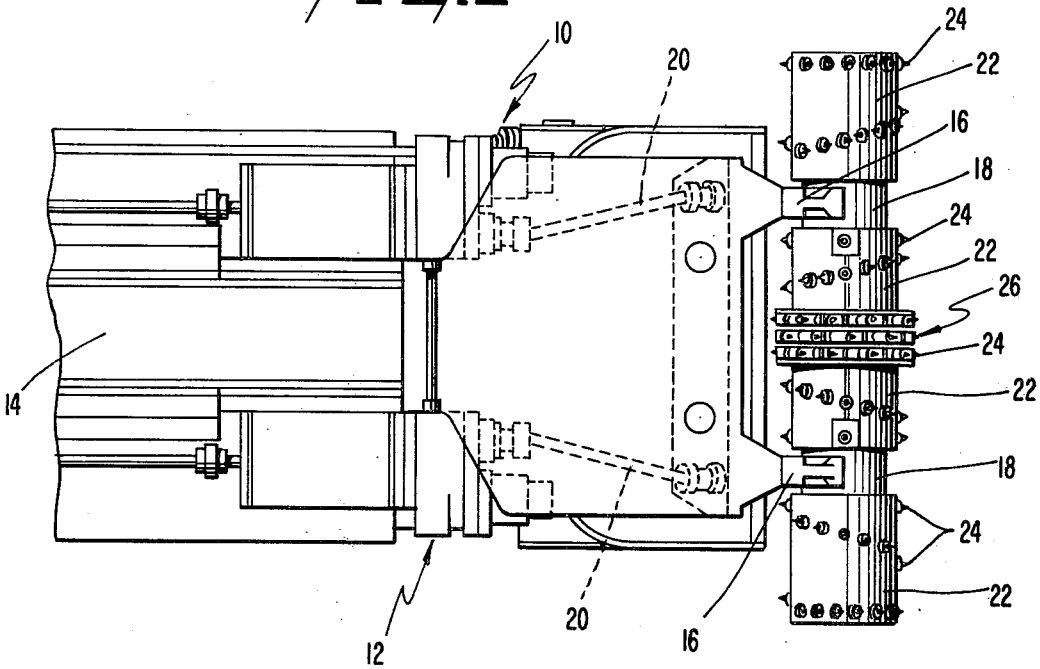
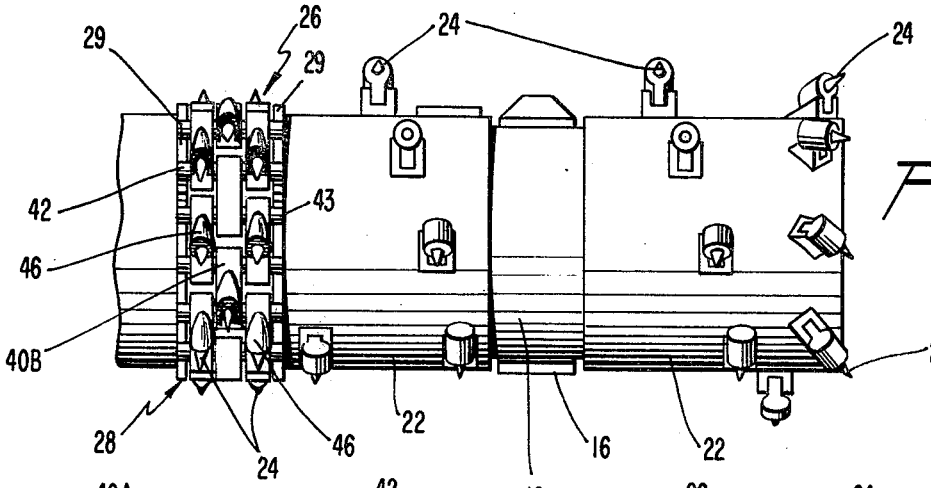
Fig. 2
Fig. 3
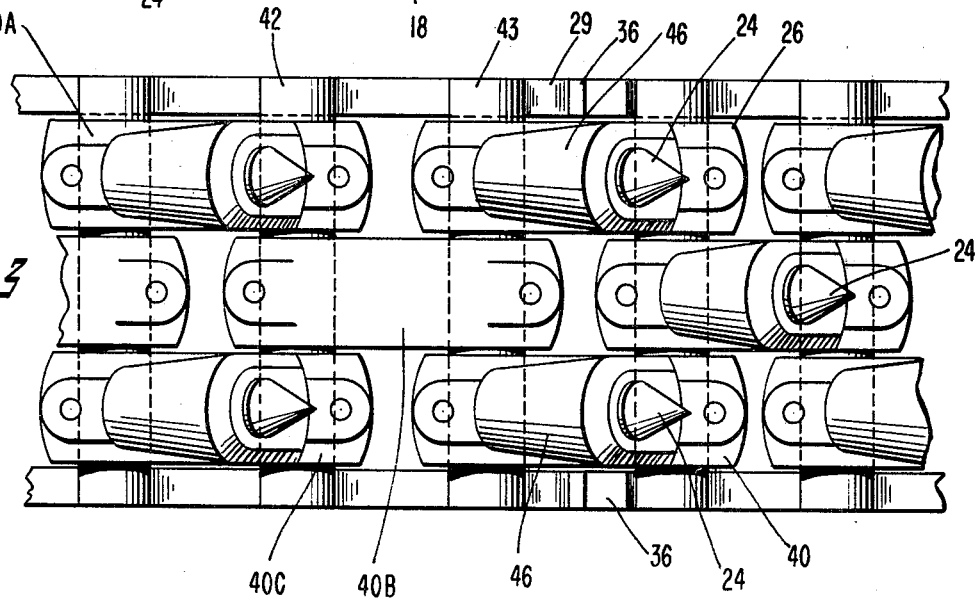

SPROCKET TIGHTENER

BACKGROUND AND OBJECTS OF THE INVENTION

The present invention relates to machines for cutting earth formations and, more particularly, to the mounting of an annular cutter chain on a rotary sprocket wheel assembly.

Machines for cutting earth formations such as coal and other mineral deposits, rocky soil, etc., often employ bits which are mounted on endless chains, the latter being driven to scrape the cutter bits against the formation being cut, as disclosed for example in a mining machine described in U.S. Pat. No. 3,305,273 issued to Kilbourne on Feb. 21, 1967.

The cutter chain may comprise one or more annular rows of links mounted on a rotary sprocket wheel assembly. The links are connected together by pins which extend parallel to the axis of rotation. The pins are engaged by teeth on the sprocket wheel to effect rotation of the chain. The links carry sockets for the reception of the cutter bits. A chain of this fashion is disclosed, for example in U.S. Pat. No. 3,784,259 issued to Munger et al on Jan. 8, 1974.

In many instances the cutter chains are mounted in elliptical fashion on a pair of spaced sprocket wheel assemblies, one of which is driven. Usually the chain is installed while in non-endless condition, i.e., with one chain pin removed. One or more of the sprocket wheel assemblies can be mounted for adjustable positioning to reduce the center-to-center spacing between the sprocket wheel assemblies. Thus, the final pin can be installed relatively easily with the chain in a slackened condition. Thereafter, the adjustable sprocket wheel assembly is adjusted to tighten the chain. By thus tightening the chain, a quieter and less wear producing operation of the chain is provided.

In other instances, certain design ad space requirements dictate that the cutter chains be wrapped in circular fashion around a single sprocket wheel assembly. This arrangement may be found in some mining machines which include a vehicle body which carries a rotary cutter mounted for rotation on a horizontal transverse shaft. The cutter includes auger drums mounted at and near the ends of the shaft, with the cutter chains located between the drums and mounted in circular fashion around a single sprocket wheel assembly keyed to the shaft. The sprocket wheel assembly may comprise a plurality of longitudinally spaced sprocket wheels which support opposite ends of the chain pins.

Whereas cutter chains mounted on a pair of sprocket wheel assemblies can be conveniently mounted in slackened condition by converging the sprocket centers, such an expedient is not available when mounting the chain in circular endless fashion around one sprocket wheel assembly. In the latter case, the chain can be deliberately sized of sufficient length so as to be in slackened condition when wrapped around the sprocket wheel. This facilitates insertion of the final chain pin, but the ensuing operation of the relatively loose chain produces excessive levels of noise and wear. On the other hand, if the chain is too tight, installation of the final chain pin is very difficult.

It is, therefore an object of the present invention to minimize or obviate problems of the type discussed above.

It is another object of the invention to provide a novel sprocket wheel for a cutting chain.

It is an additional object of the invention to enable a cutter chain to be conveniently installed in circular fashion around a sprocket wheel without the subsequent production of excessive noise and wear during operation.

It is yet another object of the invention to provide a sprocket wheel for a cutting chain which automatically compensates for wear.

BRIEF SUMMARY OF THE INVENTION

These objects are achieved by the present invention which involve a machine for cutting earth formations, of the type comprising a vehicle body, and a power driven rotary cutter mounted on the body. The cutter includes a wheel assembly and a cutter chain mounted in circular fashion around the wheel assembly. The cutter chain comprises a plurality of links connected together by transverse pins, and cutter-receiving sockets carried by the links. The wheel assembly comprises a peripheral surface for supporting the pins, and a plurality of circumferentially spaced recesses in the surface, the quantity and spacing of the recesses corresponding to the quantity and spacing of the transverse pins in the chain such that the pins can be positioned in the recesses. The recesses are of sufficient depth to support the chain in a slackened condition when the pins are positioned in the recesses. The diameter formed by non-recessed portions of the surface is large enough to prevent the pins from traveling completely out of the recesses during earth cutting operations in which the pins travel outwardly up the sides of the recesses to tighten the chain.

THE DRAWING

The advantages of the present invention will become apparent from the following detailed description of a preferred embodiment thereof in connection with the accompanying drawings in which:

FIG. 1 is a plan view of a mining machine utilizing a cutter assembly in accordance with the present invention;

FIG. 2 is a front elevational view of a rotary cutter mechanism of the mining machine;

FIG. 3 is a fragmentary plan view of a cutter chain of the rotary cutter mechanism;

DETAILED DESCRIPTION OF A PREFERRED EMBODIMENT OF THE INVENTION

Figure 4:
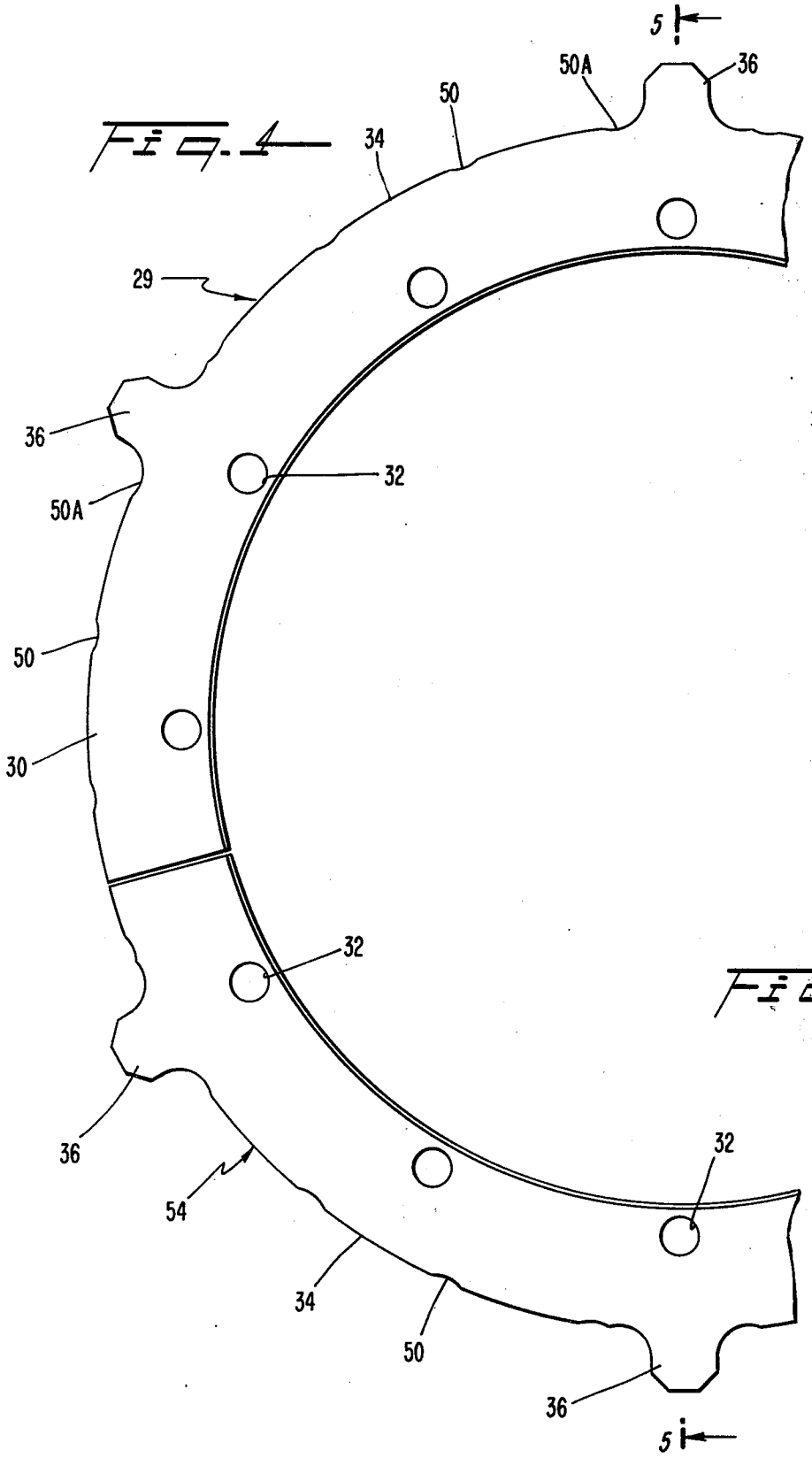
FIG. 4 is a side elevational view of a portion of a sprocket wheel according to the present invention.
Figure 5:
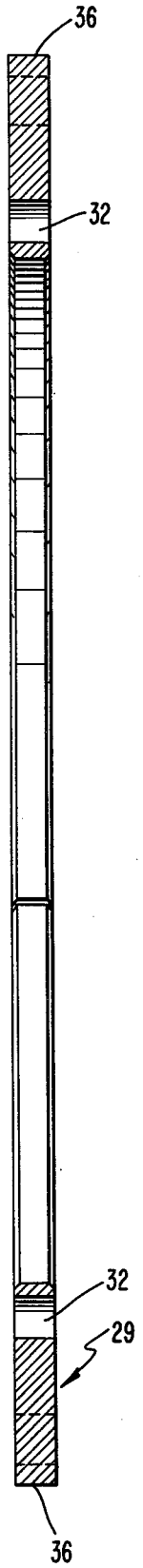
FIG. 5 is a cross-sectional view of the sprocket wheel taken along line 5—5 in FIG. 4.

A preferred embodiment of the present invention will be described in conjunction with a mining machine 10 depicted in FIGS. 1 and 2. The mining machine comprises a vehicle body 12 which can be self-propelled by means of endless tracks (not shown). A longitudinal conveyor 14 functions to transfer excavated materials from a front end of the vehicle body 12 to a rear discharge end thereof. Extending forwardly of the vehicle body are a pair of support arms 16 which support a cylindrical frame 18 in which is rotatably mounted a horizontal transverse shaft assembly (not shown).

A drive train 20 extends through the arms 16 and is operably connected to the shaft assembly to rotate the latter. Connected to the shaft assembly for rotation therewith are auger drums 22 which are mounted opposite both sides of the arms 16 and carry cutters 24 arranged in spiral-like fashion to cut an earth formation as the shaft is rotated. The cuttings are picked up by a scraper (not shown) which delivers to the conveyor 14.

Situated centrally of the shaft is an endless cutter chain 26 which is mounted in circular fashion around a sprocket wheel assembly 28, the latter being connected to the shaft for rotation therewith. The sprocket wheel assembly comprises a pair of longitudinally spaced wheels 29, each of which comprises a plurality of arc-shaped segments 30 (FIG. 4) which are mounted to a hub (not shown) on the shaft in end-to-end fashion to form a circular wheel. Apertures 32 in the wheel segments 30 are adapted to receive fasteners to rigidly connect the wheel segments to the hub and to assure that the wheels 29 rotate in unison. Each wheel segment comprises a peripheral surface 34 in the form of a circular segment and a plurality of teeth 36 projecting radially outwardly from the peripheral surface 34.

The cutter chain 26 comprises a plurality of longitudinally spaced, annular rows of links 40A,B,C, which are connected together by a series of chain pins 42, 43. The links 40B of the intermediate or central row of links are circumferentially staggered relative to the longitudinally aligned links 40A, 40C of the outer rows of links, as is apparent from FIG. 3. The pins 42, 43 are oriented transversely of the direction of rotation, or parallel to the shaft axis. Some pins 42 extend through front ends of the links 40A,C of the outer rows and the rear end of a link 40B of the intermediate row, whereas the other pins 43 extend through rear ends of the outer links 40A,C and the front end of an intermediate link 40B. In this fashion, all of the links 40 are connected together for common rotation.

The ends of the pins 42, 43 project beyond the outer links 40A,C and rest upon the sprocket wheels 29.

Mounted on some of the links 40, 41 are sockets 46 which retain the cutter bits 24. The cutter bits can be directed in any desired direction for maximum cutting benefit.

The mechanism described thus far is of a very well known, conventional nature and need not be described in further detail.

Figure 6:
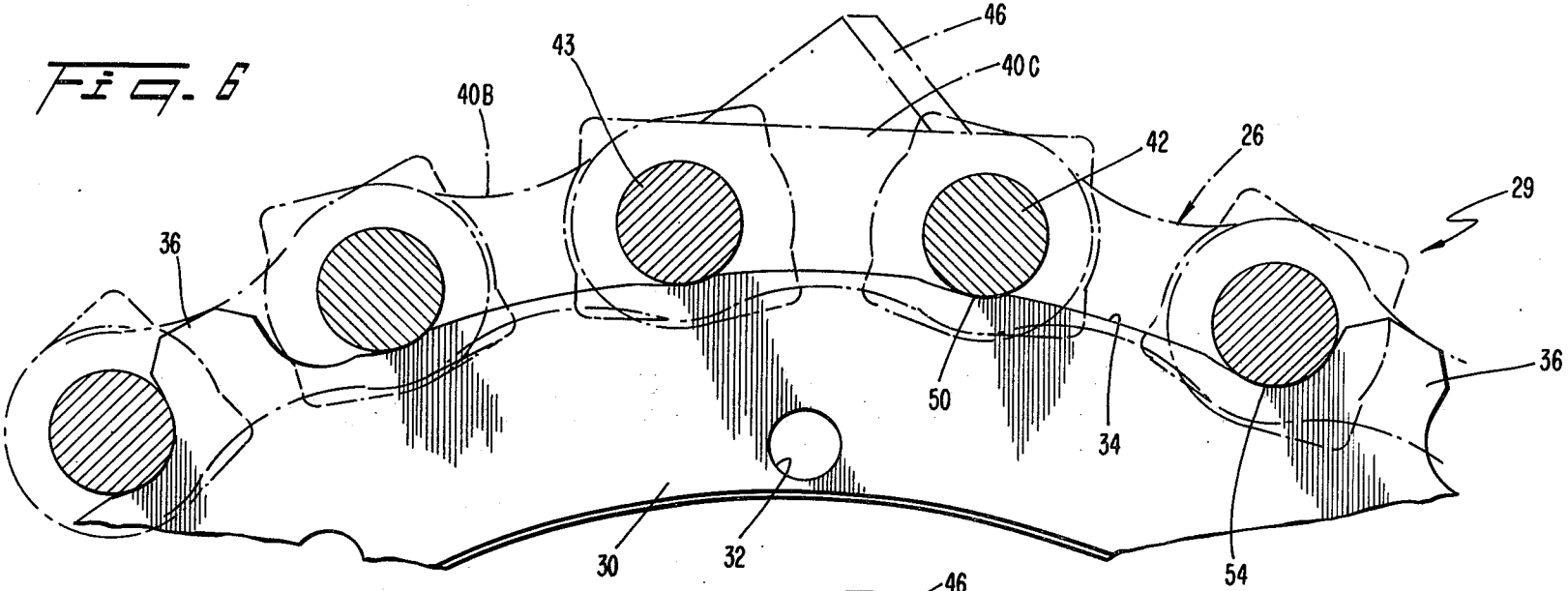
FIG. 6 is a fragmentary side view of the sprocket wheel with coupling pins of the cutter chain positioned within recesses in the sprocket wheel so as to be in a slightly slackened condition.

In accordance with the present invention the sprocket wheels 29 include a plurality of recesses 50 in the peripheral surface 34 thereof. The recesses 50 in one wheel 29 are aligned with corresponding recesses in the other wheel. The quantity and circumferential spacing of the recesses 50 correspond to the quantity and circumferential spacing of the chain pins 42, 43 so that the ends of those pins can be seated within the recesses 50, as depicted in FIG. 6. The recesses 50 comprise segments of an arc whose radius is essentially the same as that of the chain pins 42, 43, the center of rotation of the arcs being located radially outwardly of the peripheral surface 34 of the wheel 29.

Figure 7:
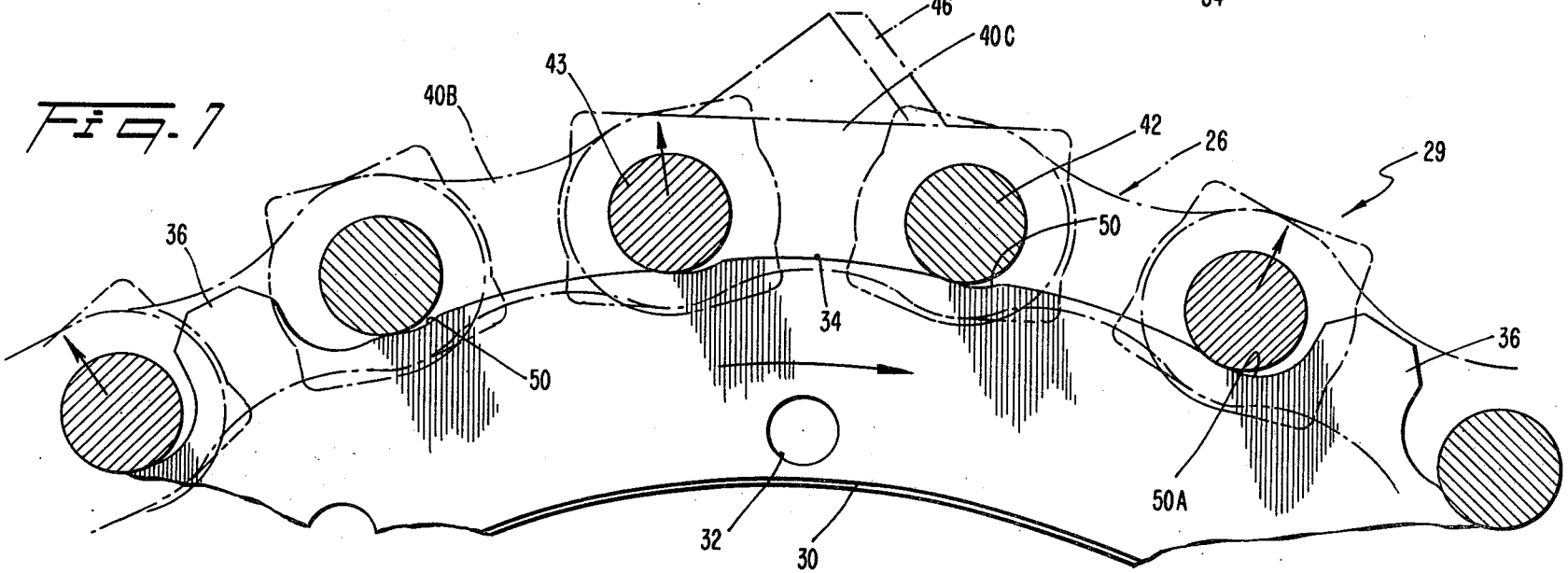
FIG. 7 is a view similar to FIG. 6 depicting the cutter chain in cutting position in which the chain pins have traveled outwardly along the side walls of the recesses.

The recesses 50 are deep enough to assure that when the pins are seated therein, the chain will be in a slightly slackened condition to facilitate the installation of the final chain pin. On the other hand, the diameter formed by non-recessed portions 52 of the peripheral surface 34 is large enough to assure that the pins 50 do not travel completely out of the recesses during a cutting operation. That is, as the chain is rotated and the cutter bits contact an earth formation, there will occur a rotation of the chain relative to the sprocket wheel in a direction opposite the direction of rotation, such that the pins 42, 43 will tend to ride up along the floor or sides of the recesses toward the non-recessed part of the peripheral surface 34 (FIG. 7). This produces a tightening action on the chain 26, thereby reducing the ensuing noise and wear during cutter operation. It will thus be realized that in the present invention rotary drive is transmitted to the chain pins by the sides of the recesses, rather than by the teeth 36 as in conventional arrangements. It will also be appreciated that the showing in FIG. 7 of the degree to which the pins travel radially outwardly along the recesses has been exaggerated for the sake of clarity.

As one example of a particularly useful arrangement embodying the present invention, a rotary coal cutter employing a pair of sprocket wheels was fabricated in which the diameter formed by the peripheral surface 34 was approximately 29⅞ inches. Twenty-four recesses 50 were formed in the outer periphery at fifteen degree intervals, there being four recesses between circumferentially adjacent sprocket teeth, the latter being spaced at sixty degree intervals. The recesses possessed a maximum depth of 0.062 inches and comprised a segment of an arc having a radius of 0.875 inches. Cutter chains whose pins had a radius of about 0.875 inches were mounted on the sprocket wheel assembly. It will be understood that recesses of any different number and size can be provided in accordance with the present invention.

If desired, some of the recesses 50A may be formed at the rear sides of the sprocket teeth 36, such that the chain pins associated therewith contact the teeth in the slackened condition of the chain. This facilitates chain installation because it merely requires that the chain be pulled in a manner producing contact between the sprocket teeth 36 and the chain pins associated therewith, in order to assure that the pins become positioned in their associated recesses. Accordingly, the final pin can be conveniently installed by virtue of the fact that the chain will be in a slightly slackened condition. During a cutting operation the pins ride up on the sides of the recesses away from the teeth 36.

Although the concept of providing recesses in the outer periphery of a sprocket wheel has been heretofore disclosed in U.S. Pat. No. 296,192 issued to Legg on Apr. 1, 1884, the disclosure of that patent relates to an arrangement in which a drive chain is mounted in elliptical fashion on a pair of spaced drive and driven sprocket assemblies and wherein the pins completely ride out of the recesses on the drive sprocket during operation.

In contrast, the present invention involves a cutter chain mounted in circular fashion on one sprocket wheel assembly and wherein the chain pins travel only partially out of the recesses during operation. As wear occurs, the pins may travel further along the recesses to compensate for such wear to provide a long useful period of utility for the recesses. Of course, the presence of the recesses 50 enables the chain to be positioned around the sprocket assembly initially in a slackened condition to facilitate installation and removal of the final pin.

The presence of the sprocket teeth 36 assures that in the event that the useful life of the recesses should expire, i.e., the pins travel completely from the recesses, rotary drive will continue to be supplied to the chain pins by the teeth 36 until the sprocket wheel assembly can be replaced.

In operation, the cutter chain 26 is wrapped around the sprocket wheel assembly 28 and pulled such as to produce contact between the sprocket teeth 36 and associated ones of the chain pins 42, 44. This assures that all pins are positioned within associated ones of the recesses 50 so that the chain is slightly slackened. In this condition of the chain the final chain pin is conveniently installed. Thereafter, as the cutter is operated, the effect of the cutting action against the cutter bits 24 causes the chain pins to ride radially outwardly along the side of the recesses 50 so as to tighten the chain for quieter operation with reduced wear. As wear does occur, the chain pins automatically adjust by riding further along the recesses. Accordingly, problems involving installation, noise and wear in connection with endless cutter chains of the circular type are resolved by the present invention.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a machine for cutting earth formations, of the type comprising a vehicle body, and a power driven rotary cutter mounted on said body, said cutter including wheel means and a cutter chain mounted in circular fashion around said wheel means, said cutter chain comprising a plurality of links connected together by transverse pins, and cutter-receiving sockets carried by said links, the improvement wherein said wheel means comprises a peripheral surface for supporting said pins, and a plurality of circumferentially spaced recesses in said surface, the quantity and spacing of said recesses corresponding to the quantity and spacing of said transverse pins in said chain such that said pins can be positioned in said recesses, said recesses being of sufficient depth to support said chain in a slackened condition when said pins are positioned in said recesses, and the diameter formed by nonrecessed portions of said surface being large enough to prevent said pins from traveling completely out of said recesses during earth cutting operations in which said pins travel outwardly upon the sides of said recesses to tighten the chain.

2. Apparatus according to claim 1, wherein said wheel means comprises a plurality of longitudinally spaced wheels, the recesses in one wheel being aligned with the recesses in another wheel.

3. Apparatus according to claim 1, wherein said recesses each comprise a segment of an arc whose radius is essentially the same as the radius of said chain pins, and whose center of rotation is located radially outwardly of the peripheral surface of said wheel means.

4. Apparatus according to claim 1, wherein said wheel means includes a plurality of circumferentially spaced, radial teeth, there being a plurality of said recesses between each pair of circumferentially adjacent teeth.

5. Apparatus according to claim 4, wherein at least some of said recesses are positioned at the back sides of said teeth so that, during chain installation, positioning of said chain to produce contact between such teeth and the associated chain pins assures that all chain pins are located in their associated recesses.

6. In a mining machine of the type comprising a vehicle, horizontal transverse shaft means mounted for rotation at the front of the vehicle, means for rotating said shaft means, and cutter means mounted on said shaft means, said cutter means including a pair of longitudinally spaced toothed sprocket wheels mounted on said shaft means for rotation therewith, and a cutter chain mounted in circular fashion around said sprocket wheels, said chain comprising a plurality of links connected together by transverse pins and cutter-receiving sockets carried by said links, the improvement wherein said sprocket wheels each comprise a peripheral surface on which radial teeth are carried, there being a plurality of circumferentially spaced recesses disposed between each circumferentially adjacent pair of teeth, each recess in one wheel being aligned with a recess in the other wheel to form circumferentially spaced pairs of recesses; the quantity and spacing of said pairs of recesses corresponding to the quantity and spacing of said transverse pins in said chain such that each pin can be positioned in a pair of said recesses, said recesses being of sufficient depth to support said chain in a slackened condition when said pins are positioned in said recesses, and the diameter formed by non-recessed portions of said surface segments being large enough to prevent said pins from traveling completely out of said recesses during subsequent earth cutting operations in which said pins travel outwardly upon sides of said recesses to tighten the chain.

7. Apparatus according to claim 6, wherein at least some of said recesses are positioned at the back sides of said teeth so that, during chain installation, positioning of said chain to produce contact between such teeth and the associated chain pins assures that all chain pins are located in their associated recesses.

8. Apparatus according to claim 6, wherein said recesses each comprise a segment of an arc whose radius is essentially the same as the radius of said chain pins, and whose center of rotation is located radially outwardly of the peripheral surface of said wheel means.

* * * * *